US006070666A

United States Patent [19]

Montgomery

[11] Patent Number: 6,070,666

[45] Date of Patent: Jun. 6, 2000

[54] FRACTURING METHOD FOR HORIZONTAL WELLS

[75] Inventor: Carl T. Montgomery, Plano, Tex.

[73] Assignee: Atlantic Richfield Company, Los Angeles, Calif.

[21] Appl. No.: 09/070,579

[22] Filed: Apr. 30, 1998

[51] Int. Cl.[7] ..... E21B 43/267

[52] U.S. Cl. ..... 166/308; 166/280; 166/281

[58] Field of Search ..... 166/280, 308, 166/281

[56] References Cited

U.S. PATENT DOCUMENTS

| | | | |
|---|---|---|---|
| 5,330,005 | 7/1994 | Card et al. | 166/280 |
| 5,353,874 | 10/1994 | Manulik | 166/281 |
| 5,547,023 | 8/1996 | McDaniel et al. | 166/280 |
| 5,620,049 | 4/1997 | Gipson et al. | 166/248 |
| 5,791,415 | 8/1998 | Nguyen et al. | 166/280 |
| 5,908,073 | 6/1999 | Nguyen et al. | 166/276 |

OTHER PUBLICATIONS

"A Novel Technology to Control Proppant Backproduction", by R.J. Card, P.R. Howard and J–P Féraud; SPE 31007; SPE Production & Facilities, Nov. 1995.

*Primary Examiner*—William Neuder
*Assistant Examiner*—Zakiya Walker
*Attorney, Agent, or Firm*—F. Lindsey Scott

[57] ABSTRACT

A method for fracturing a horizontal well at a plurality of locations along the length of the horizontal portion of the well by plugging previously fractured downstream fracture zones with a mixture of a proppant and a slump-inhibiting material.

14 Claims, 3 Drawing Sheets

FRACTURING METHOD FOR HORIZONTAL WELLS

FIELD OF THE INVENTION

This invention relates to a method for efficiently fracturing a horizontal well at a plurality of locations along the length of the horizontal portion of the well.

BACKGROUND OF THE INVENTION

In vertical wells it is frequently desirable to fracture from the well at various locations along the length of the well. In other words, a given well may penetrate various oil-bearing or other zones of interest and it may be desirable to fracture each of the oil-bearing or other zones of interest. Typically, the fractures cannot be done simultaneously for a variety of reasons.

Such wells may be cased or uncased through the formations of interest but, for purposes of simplicity, the typical practices will be discussed by reference to cased wells. The well is typically perforated through a first, and typically a lower, zone of interest. A tubing is then extended into the well to a depth above the first zone of interest and a packer is positioned to prevent the flow of fracturing fluid upwardly in the well between the outside of the tubing and the inside of the casing. A fracturing fluid is then injected into the well to fracture the formation through the perforations or, in the case of an uncased well, through a notched area of the formation of interest. After the fracturing has been completed, a sand plug is positioned over the fractured formation by filling the well with sand to a suitable level and thereafter a formation above the sand plug can be perforated and fractured by a similar technique. By the use of sand plugs of a variety of depths, a plurality of formations in the vertical well can be fractured independently of the other fractured zones. Typically, each zone is perforated separately so that the sand plug effectively isolates all the zones below the zone being perforated. Zones above the zone being perforated are typically perforated subsequently or are isolated from the zone being perforated by the packer.

In horizontal wells, by contrast, sand plugs are not readily usable because the sand slumps and exposes the fractures in the previously fractured zone, thereby exposing the previously fractured zones downstream from the packer to the pressure imposed to fracture at a second location upstream from the first fractured zone. The term "downstream" in this discussion is used to refer to the outer end of a horizontal section extending from a generally vertical section of a well with the term "upstream" being used to refer to locations in the well between the outer end of the horizontal section of the well and the end of the horizontal section at its junction with the vertical section of the well.

Typically, pairs of packers have been used to isolate a zone to be fractured in the horizontal section of the well. The packers are carried into the well on a tubing or other suitable tool string with the first packer being set downstream of the fracture zone and the second packer being set upstream of the packer zone with fracturing fluid thereafter being injected into a fracture zone between the two packers to fracture the horizontal well at the desired location. A plurality of zones in the horizontal section can readily be fractured separately using this technique, but it is a relatively expensive and complicated technique.

Accordingly, since it is desirable in many instances to fracture horizontal wells/sections at a plurality of locations along the length of the horizontal portion of the well, improved and more efficient methods have been sought for this purpose.

SUMMARY OF THE INVENTION

According to the present invention, horizontal wells are efficiently fractured at a plurality of locations along the length of the horizontal section of the well by a method comprising injecting a fracturing fluid into a first fracture zone at fracturing conditions, fracturing the well at a first location from the first fracture zone, substantially filling the first fracture zone with a mixture of proppant and slump-inhibiting material to plug the first fracture zone, injecting a fracturing fluid into a second fracture zone upstream from the plugged first fracture zone at fracturing conditions, and fracturing the well at a second location from the second fracture zone.

A plurality of fracture zones may be fractured at a plurality of locations along the length of the horizontal section of the well by injecting a fracturing fluid into each fracture zone at fracturing conditions with previously fractured downstream fracture zones being plugged with the mixture of proppant and slump-inhibiting material.

DESCRIPTION OF PREFERRED EMBODIMENTS

In the discussion of the Figures, the same numbers will be used throughout to refer to the same or similar components.

Figure 1:
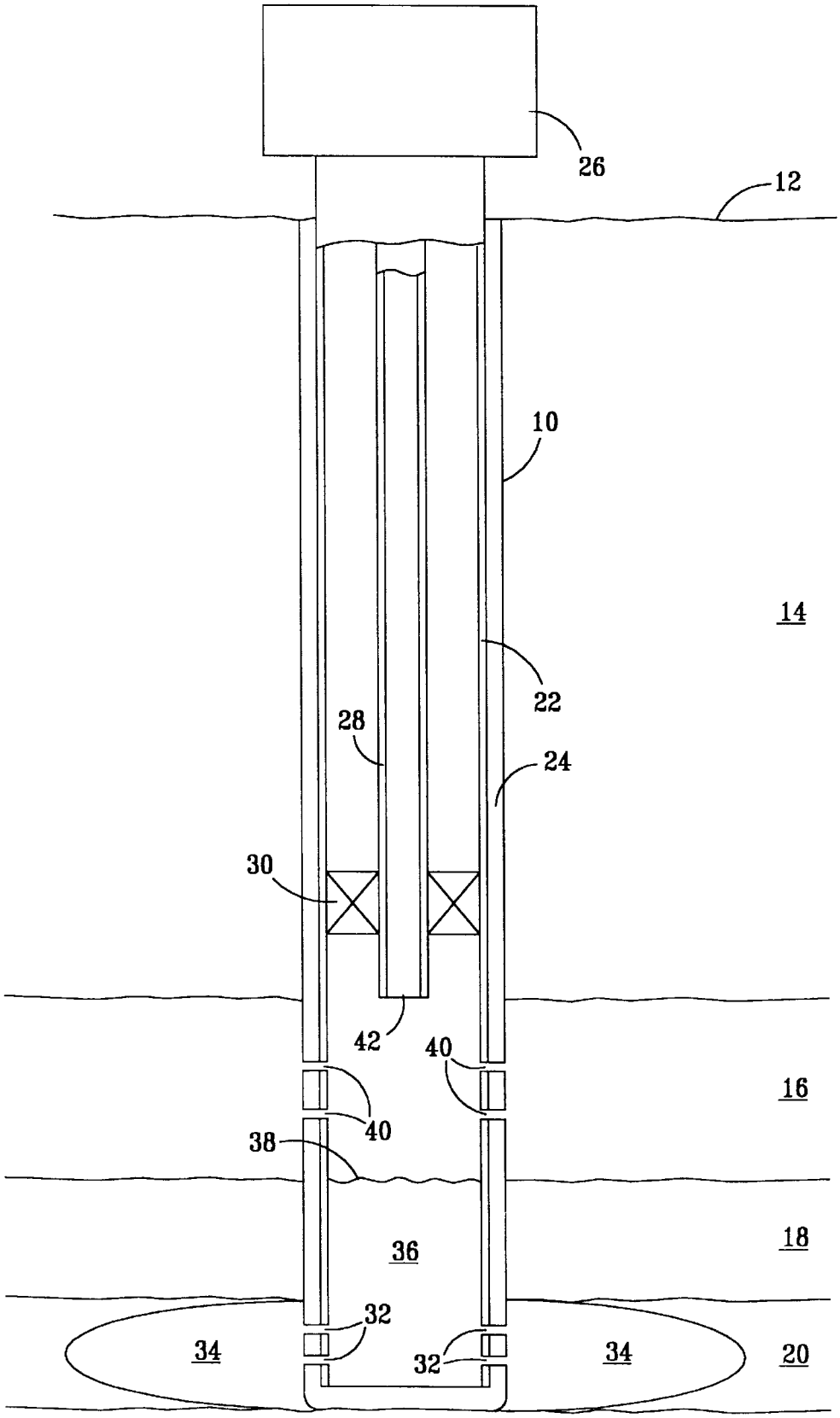
FIG. 1 is a schematic diagram illustrating a prior art technique for fracturing a plurality of formations penetrated by a vertical wellbore.

In FIG. 1 a prior art vertical well is shown. The well comprises a wellbore 10 extending from a surface 12 through an overburden 14, a first oil-bearing formation 16, a non oil-bearing formation 18 and a second oil-bearing formation 20. The well includes a casing 22 substantially to the bottom of formation 20 with casing 22 being cemented in place by cement 24. The well has been fractured in formation 20 by injecting a fracturing fluid typically including a proppant which may or may not include a proppant retention material via perforations 32 into fractures 34 in formation 20. This fracturing operation has been completed and a sand plug 36 has been positioned in casing 22 to a depth 38. A tubing 28 is positioned in casing 22 from surface 12 via a well head 26 as known to those skilled in the art for controlling the flow of fluids into and from casing 22 and tubing 28. Tubing 28 is positioned to end above perforations 40 formed through casing 22 and cement 24 into formation 16. A packer 30 is positioned to prevent the flow of fracturing fluid upwardly between the outside of tubing 28 and the inside of casing 22. The well, as shown, is in condition to fracture formation 16 without imposing fracturing pressure on perforations 32 or fractures 34 in formation 20.

Fracturing using techniques of this type is well known for the formation of multiple fractures at multiple locations in vertical wells. As noted previously, however, this technique does not work with horizontal wells since the sand tends to slump in the horizontal well, thereby exposing the fractures at previously fractured locations to fracturing pressure from the second and subsequent fracturing operations. This results in unwanted extensions of the first fractures, loss of fracturing fluid and a variety of other problems. Typically, fractures at multiple locations in horizontal sections of horizontal wells have been accomplished using arrangements of multiple packers to isolate the desired zone for fracturing. As noted, this is an expensive and complicated procedure and, while it is a commonly-used technique, it is desirable that a more economical and efficient method be available.

Figure 2:
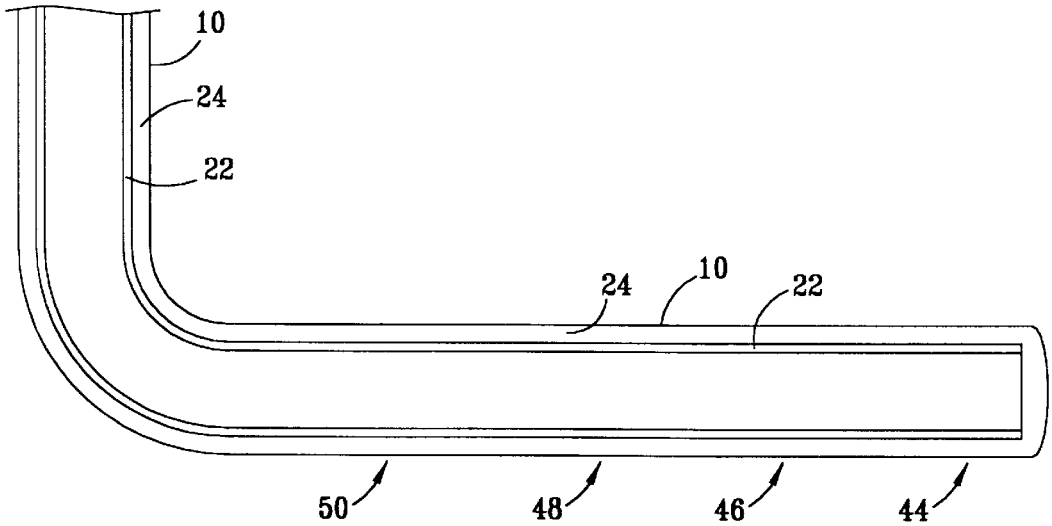
FIG. 2 is a schematic diagram of a horizontal well indicating a plurality of desired fracture zones in the horizontal section of the well.

In FIG. 2 a schematic representation of the lower portion of a horizontal wellbore is shown. The wellbore is cased and is desirably fractured at fracture points 44, 46, 48 and 50. FIGS. 3, 4, 5 and 6 show a portion of the horizontal section of the wellbore shown in FIG. 2.

Figure 3:
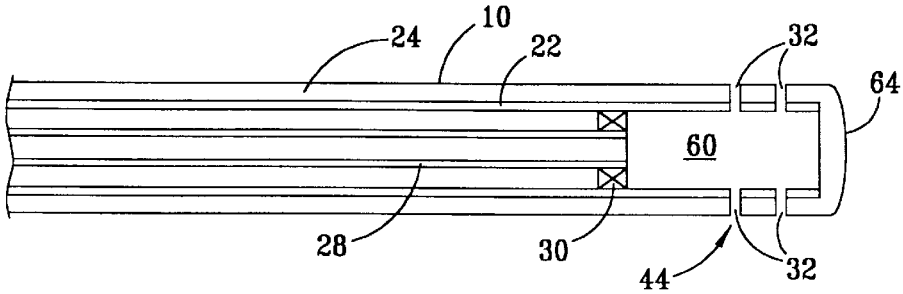
FIG. 3 is a schematic view of a portion of the horizontal section of a horizontal wellbore including perforations, tubing and packing positioned to fracture from a first fracture zone.

In FIG. 3 a tubing 28 has been extended to end near perforations 32 at a first fracture point 44. A packer 30 is positioned to prevent the flow of fracturing fluid between the inside of casing 22 and the outside of tubing 28. The packer 30, an outer end 64 of the horizontal well and the inside of casing 22 form a first fracture zone 60. Fracturing fluid is injected into first fracture zone 60 at fracturing pressure to form fractures extending from perforations 32. The fracturing fluid injected into fractures 34 (shown in FIG. 4) via perforations 32 may include a proppant and a slump-inhibiting material.

The proppant may be any suitably inert finely-divided particulate material such as sand, ceramic beads, glass microspheres, synthetic organic beads, sintered materials and the like. Typically proppants are of a particle size from about 10 to about 100 US mesh.

Figure 5:
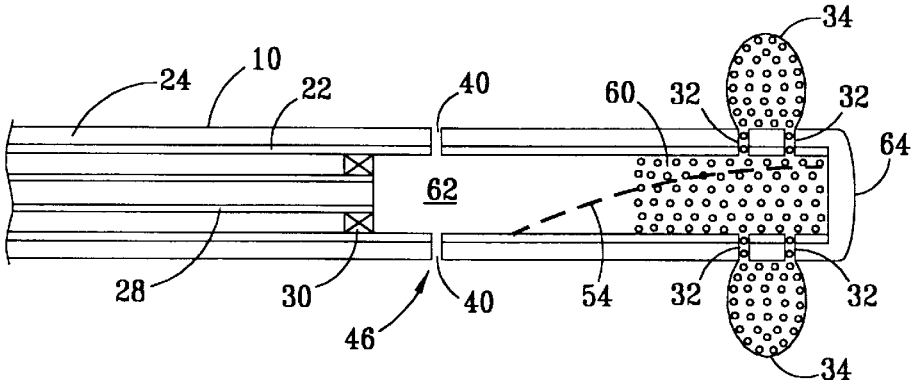
FIG. 5 is a schematic diagram of the same horizontal well section shown in FIG. 4 including a tubing and packer positioned to fracture from a second fracture zone after fracturing from the first fracture zone.

The slump-inhibiting material is any suitable material for inhibiting the slumping of the proppant material left in first fracture zone 60. Some suitable slump-inhibiting materials are fibers which are stable in the presence of the fracturing fluid and well fluids. Some suitable fibers are natural organic fibers, synthetic organic fibers, glass fibers, ceramic fibers, inorganic fibers, metal fibers, carbon fibers and the like. Materials such as straw, cotton and other materials in finely divided form have been used. The fiber is mixed with the proppant in quantities typically from about 0.01 to about 50 weight percent, and preferably from about 0.1 to about 5 percent, by weight of the proppant. The fibers are suitably of a diameter from about 2 to about 200 microns and of a length up to about 100 millimeters. In general, the fibers are mixed with the proppant in an amount sufficient to prevent slumping when the proppant is free-standing. Such fibers are disclosed for use in the control of flowback in subterranean wells in U.S. Pat. No. 5,330,005 "Control of Particulate Flowback in Subterranean Wells" issued Jul. 19, 1994 to Card et al. This patent is hereby incorporated in its entirety by reference. In other words, when first fracturing zone 60 is filled with a mixture of proppant and slump-inhibiting material, such as fibers, the proppant remains positioned across the entire width of casing 22, as shown in FIG. 5 when tubing 28 and packer 30 are removed. By contrast, as shown in FIG. 5 by dotted line 54 referred to as a slump line, when no fiber or other slump-inhibiting material is present, the proppant tends to slump upon the removal of tubing 28 and packer 30 to the position shown by line 54. This position clearly exposes perforations 32 and fractures 34 to pressure during a subsequent upstream fracturing operation.

Other slump-inhibiting materials consist of curable resins or pre-cured resins on proppant materials. The resins may be mixed with proppants and cured in the formation at formation conditions or hardened by the injection of a hardening material. The resins may also be at least partially coated onto at least a portion of the proppant material in a pre-cured condition so that the resins completely cure in the formation at formation conditions. Some suitable resins are epoxy resins, phenolic resins, furfural alcohol resins, mixtures thereof and the like. Such variations are well-known to those skilled in the art and are used for the prevention of proppant back-production from fracturing operations and for other proppant control purposes. The use of both fibers and curable resins is considered to be well-known to those skilled in the art and is discussed in "A Novel Technology to Control Proppant Backproduction", R. J. Card, P. R. Howard and J-P. Férard, SPE Introduction & Facilities, November 1995.

Further, the proppant may be mixed with both resin and suitable fibers, such as those discussed above, with the entire mixture then being used in the fracturing fluid.

The fracturing operation may be conducted with no proppant, proppant alone, with the use of curable resins and proppant in various combinations, with the use of fiber and proppant or fiber, curable resin and proppant in various combinations as known to those skilled in the art. According to the method of the present invention, any such fracturing technique can be used, provided the fracture zone 60 is left at least substantially filled with a mixture of proppant and a slump-inhibiting material when tubing 28 and packer 30 are withdrawn.

Figure 4:
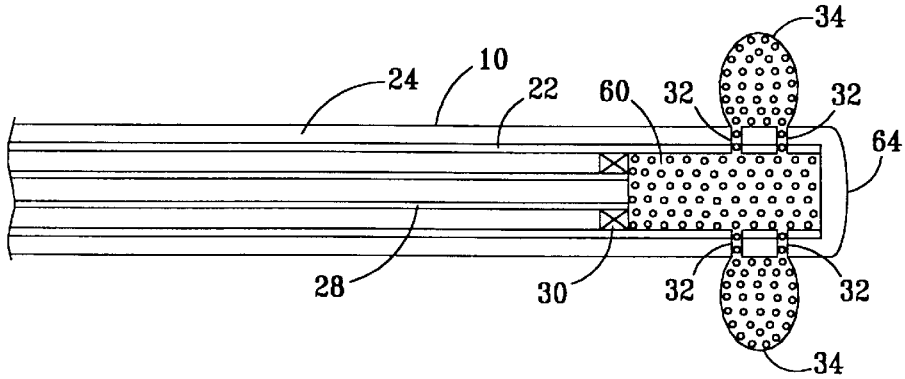
FIG. 4 is a schematic diagram of the embodiment of the FIG. 3 after fracturing and positioning a mixture of proppant and a slump-inhibiting material in the first fracture zone.
Figure 6:
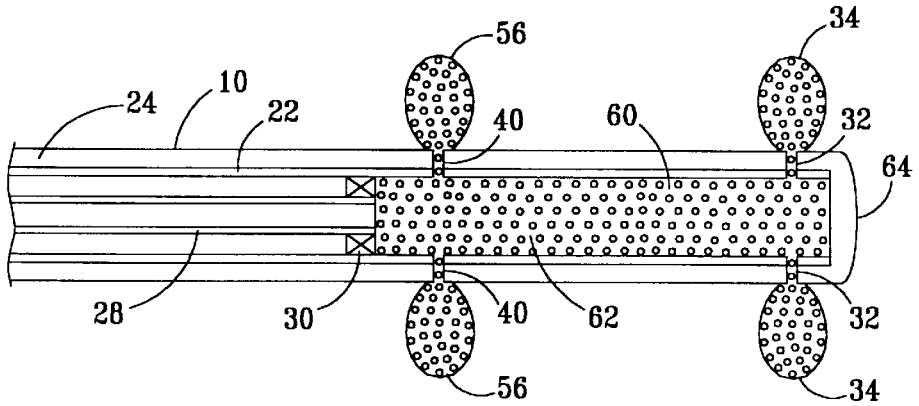
FIG. 6 is a schematic diagram of the embodiment of FIG. 5 after fracturing from the second fracturing zone and positioning a mixture of proppant and a slump-inhibiting material in the second fracture zone.

In any event, the fracturing fluid is injected via tubing 28, as shown in FIG. 4 to form fractures 34 from perforations 32. As known to those skilled in the art, proppant can be positioned to substantially fill fractures 34, perforations 32 and first fracture zone 60. This can be accomplished by control of liquid bleed-off and other techniques known to those skilled in the are to substantially fill first fracture zone 60, perforations 32 and fractures 34 with the mixture of proppant and slump-inhibiting material. It may be necessary, when a curable resin slump-inhibiting material is used, to retain packer 30 and tubing 28 in position for a suitable period of time to permit the mixture to cure. After the first fracture zone 60 has been filled with the mixture and allowed to set, if necessary, tubing 28 and packer 38 are withdrawn to a second position, as shown in FIG. 5, to expose perforations 40 in casing 22 at a second fracture point 46. Perforations 40 may be formed before fracturing from first fracture zone 60 or after fracturing from first fracture zone 60. It will be noted that first fracture zone 60 remains filled with the mixture of proppant and slump inhibitor. The steps required to fracture the first fracture zone 60 at a fracture point 46 are readily repeated in a second fracture zone 62 defined by the end of tubing 28, packer 30 and the upstream end of first fracture zone 60, as shown in FIG. 5. After fracturing from second fracture zone 62, via at least one perforation 40 to form second fractures 56, second fracture zone 62 is filled with the mixture of proppant and slump-inhibiting material, as shown in FIG. 6.

By repeating this process, a plurality of fracture zones can be fractured at desired fracture points in the horizontal portion of a horizontal well. The present method avoids the necessity for multiple packers to isolate a fracture zone while still protecting the previously fractured zones from the imposition of fracturing pressure from the succeeding zone. A plurality of fracture points may be fractured by successively fracturing while retaining the mixture of proppant and slump-inhibiting material in the previously fractured zones.

Figure 7:
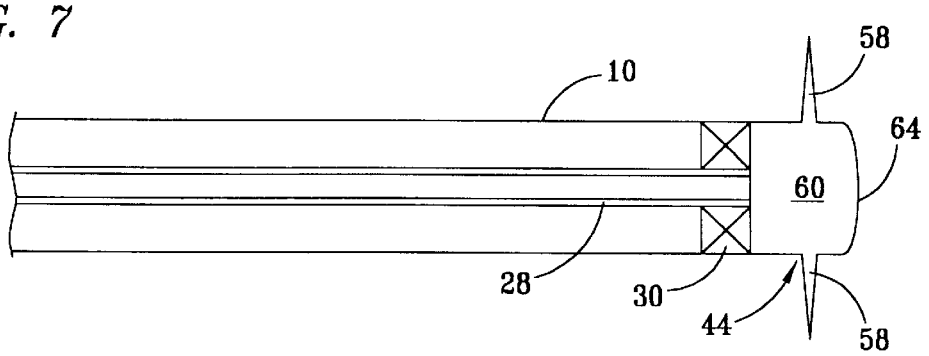
FIG. 7 is a schematic diagram of a portion of an uncased portion of a horizontal wellbore showing a tubing and packer positioned to fracture from a first fracture zone.

While the discussion of the invention in FIGS. 3–6 has related to a cased well with the casing being cemented in place, the method of the present invention is equally useful with open-hole completions. In FIG. 7, a first fracture zone 60 is shown with notches extending from a desired fracture point 44. Upon the injection of fracturing fluid into first fracture zone 60, fractures can be formed from notches 58 at a desired fracture point 44. The operation of the method of the present invention is the same for subsequent fracture zones, as discussed in conjunction with cased wellbores.

As well-known to those skilled in the art, notched formations can be used with perforations through casings. While the present invention has been discussed with reference to casings of a constant diameter, it is well-known to those skilled in the art to use casings of varying diameters, particularly as the well depth increases. Such variations in state-of-the-art well completions are considered to be known to the art and have not been discussed in detail, since such discussion is not necessary to the further description of the present invention.

Upon completion of all fracturing operations, the mixture of proppant and slump-inhibiting material may be removed from the well by sand washing or the like. If a curable resin slump-inhibiting material is used, it may be necessary to drill the mixture from the well. Such operations are considered to be well-known to those skilled in the art.

Having thus discussed the present invention by reference to certain of its preferred embodiments, it is respectfully pointed out that the embodiments discussed are illustrative rather than limiting in nature and that many variations and modifications are possible within the scope of the present invention. Many such variations and modifications may be considered obvious and desirable by those skilled in the art based upon the foregoing description of preferred embodiments.

I claim:

1. A method for fracturing a horizontal well having a horizontal portion at a plurality of locations along the horizontal portion of the well, the method comprising:

a) injecting a fracturing fluid into a fist fracture zone comprising a length of at least one of a tubular member and a wellbore wall in fluid communication with a first fracture point at fracturing conditions;

b) fracturing the well at the first fracture point from the first fracture zone;

c) substantially filling an interior of the tubular member and any annular space between an outside of the tubular member and an inside of the wellbore and in fluid communication with the first fracture point and a source of a mixture of proppant and slump-inhibiting material or the wellbore in the first fracture zone with the mixture of proppant and slump-inhibiting material to plug the first fracture zone;

d) injecting a fracturing fluid into a second fracture zone upstream from the plugged first fracture zone and comprising a length of at least one of a tubular member and a wellbore wall in fluid communication with a second fracture point at fracturing conditions; and e) fracturing the well at the second fracture point from the second fracture zone.

2. The method of claim 1 wherein a plurality of fracture zones are fractured at a plurality of fracture points along the horizontal portion of the well by injecting a fracturing fluid into each fracture zone at fracturing conditions with previously fractured downstream fracture zones being plugged with the mixture of proppant and slump-inhibiting material.

3. The method of claim 1 wherein the fracturing fluid is injected into the first fracture zone through a tubing in fluid communication with a source of fracturing fluid and the first fracture zone.

4. The method of claim 3 wherein a packer is positioned between an outer wall of the tubing and in inside of the well to prevent a flow of fracturing fluid out of the first fracture zone through an annulus between the outer diameter of the tubing and the inside of the well.

5. The method of claim 3 wherein the well contains a casing and wherein a packer is positioned between an outer wall of the tubing and an inside of the casing to prevent a flow of fracturing fluid out of the first fracture zone through an annulus between the outer diameter of the tubing and the inside of the casing.

6. The method of claim 1 wherein the slump-inhibiting material is selected from the group consisting of natural organic fibers, synthetic organic fibers, glass fibers, ceramic fibers, inorganic fibers;, metal fibers and carbon fibers.

7. The method of claim 6 wherein the fibers have a diameter from about 2 to about 200 microns and a length up to about 100 millimeters.

8. The method of claim 6 wherein the slump-inhibiting material is glass fibers.

9. The method of claim 1 wherein the slump-inhibiting material is a curable or a pre-cured resin on a proppant.

10. The method of claim 9 wherein the resin is selected from the group consisting of epoxy resins, phenolic resins, furfural alcohol resins and mixtures thereof.

11. The method of claim 1 wherein the mixture comprises a proppant, a suitable resin and a suitable fiber.

12. The method of claim 11 wherein the resin is selected from the group consisting of epoxy resins, phenolic resins and furfural alcohol resins.

13. The method of claim 11 wherein the fiber is selected from the group consisting of organic polymer fibers, glass fibers, ceramic fibers and carbon fibers.

14. The method of claim 11 wherein at least a portion of the resin is pre-cured on at least a portion of the proppant.

* * * * *